US005491948A

United States Patent [19]

Harris

[11] Patent Number: 5,491,948

[45] Date of Patent: Feb. 20, 1996

[54] TILT-UP CONCRETE PAD AND METHOD OF FORMING AND ERECTING THE TILT-UP CONCRETE PAD

[76] Inventor: Dallas L. Harris, 106 Seapath, Wrightsville Beach, N.C. 28480

[21] Appl. No.: 171,674

[22] Filed: Dec. 22, 1993

[51] Int. Cl.[6] ..... E04B 2/00

[52] U.S. Cl. ..... 52/596; 52/601; 52/376; 52/604; 52/292; 52/295; 52/250

[58] Field of Search ..... 52/596 OR, 601, 52/376, 600, 604, 367, 292, 293.1, 293.3, 295, 741.1, 745.2, 745.13, 250

[56] References Cited

U.S. PATENT DOCUMENTS

| | | | |
|---|---|---|---|
| 1,031,926 | 7/1912 | Hansbrough | 52/601 X |
| 1,394,550 | 10/1921 | Herbrick | 52/601 X |
| 1,428,147 | 9/1922 | Davis | 52/600 X |
| 1,674,628 | 6/1928 | Ashenhurst | 52/367 X |
| 1,953,203 | 4/1934 | Venzie | 52/601 X |
| 2,310,442 | 2/1943 | Knudsen | 52/600 X |
| 2,883,852 | 4/1959 | Midby | 52/601 X |
| 3,359,022 | 12/1967 | Russell | 52/601 X |
| 3,372,519 | 3/1968 | Russell | 52/601 X |
| 4,209,954 | 7/1980 | Scheid | 52/601 |
| 4,364,987 | 12/1982 | Goodwin | 52/601 X |

*Primary Examiner*—Wynn E. Wood
*Attorney, Agent, or Firm*—Rhodes, Coats & Bennett

[57] ABSTRACT

The present invention relates to a tilt-up concrete pad and the method or process for forming the tilt-up concrete pad and erecting a building comprised of a series of such tilt-up concrete pads. The precast concrete pad includes reinforcing rebar and embedded angled anchor plates that are secured to the embedded rebar and project therefrom where a portion of the angled anchor plates referred to as weld pads lie flush with the backside of the precast concrete pad. The respective precast concrete pads are placed around a foundation and are connected together by a series of connecting bars that are welded or secured on opposite ends to respective weld pads exposed on the back side of adjacently disposed concrete pads. The present disclosure also shows a work station used for pouring and manufacturing the concrete pads that form the present invention. The work station is designed to support a detachable form and includes a provision for allowing the forks of a forklift to be inserted underneath the poured concrete pad such that the same can removed from the work station. Further, the present invention entails a method of erecting such tilt-up concrete pads and securing them together on a foundation to form a building structure.

6 Claims, 8 Drawing Sheets

TILT-UP CONCRETE PAD AND METHOD OF FORMING AND ERECTING THE TILT-UP CONCRETE PAD

FIELD OF INVENTION

The present invention relates to tilt-up concrete construction, and more particularly to tilt-up concrete pads, a method of producing the tilt-up concrete pads, and a method of erecting and connecting respective concrete pads together to form a concrete building structure.

BACKGROUND OF THE INVENTION

Tilt-up concrete construction has been used in the past to produce concrete building structures. Basically, the walls of the building are formed by a series of concrete pads or slabs that are precast and then erected around a foundation wall. Typically, the builder will employ various means to anchor the respective concrete pads or slabs to a foundation and to each other. Once the respective concrete pads or slabs have been erected on the foundation and secured together, a roof structure is then erected across the composite concrete wall structure of the building and the interior sides of the concrete wall are finished.

There are many advantages to concrete building structures. However, in the past, one of the major drawbacks to tilt-up concrete pad construction is that builders have found it difficult to devise a practical and workable system for producing the concrete pads, erecting the concrete pads and securely connecting and anchoring the concrete pads around a foundation structure. Expressed in another way, no one has come forward with a practical, economical way of manufacturing and erecting concrete pads especially in the area of residential building. Too often, the processes used by builders, especially in the area of residential construction, has been expensive and difficult to manage.

Beyond the above, another drawback that has been found in the past with respect to concrete residential homes is that it has been difficult to design a system that yields an economical and attractive home inside and out. Too often, the resulting concrete building structure carries with it an appearance that is not viewed with great favor by potential homeowners. In this regard, too often, such concrete residential homes in the past have had an appearance that tends to look more like a commercial building than a home. For that reason, it is appreciated that the demand for concrete residential homes have suffered.

Therefore, there has been and continues to be a need for a practical and economical approach to concrete construction especially in residential home building.

SUMMARY AND OBJECTS OF THE INVENTION

The present invention entails a method or process for producing tilt-up concrete pads and for erecting and connecting the same that is practical, economical, and suitable for residential buildings. Accordingly, the present invention presents a new tilt-up concrete pad design that is relatively simple and which lends itself to mass manufacturing. Also, the present invention entails a process for erecting the concrete tilt-up pads on a foundation and connecting the respective pads and anchoring them to a foundation through a process that is relatively simple and straightforward to produce a residential building structure that is durable and strong and in fact is so strong that the erected concrete structure will withstand winds of 120 miles per hour.

It is therefore an object of the present invention to provide a tilt-up concrete construction method and system that is practical and economical, and which is particularly suited for residential construction.

Another object of the present invention is to provide a tilt-up concrete construction method and system that lends itself to mass production.

Another object of the present invention is to provide a tilt-up concrete pad that can be easily formed and handled and which is particularly designed to yield a favorable exterior appearance while at the same time being designed such that the same can be easily and conveniently finished on the inside.

Another object of the present invention resides in the provision of a concrete building construction process that produces a concrete composite wall structure that is able to withstand hurricane force winds of 120 miles per hour or greater.

Also, an object of the present invention is to provide a concrete pad that can easily be incorporated into a composite concrete wall that is durable and which will inherently have a very long life.

It is also an object of the present invention to provide a tilt-up concrete pad design that is very versatile inasmuch as a concrete pad can be manufactured with window and utility blanks appropriately located.

Another object of the present invention resides in the provision of a tilt-up concrete pad construction process that lends itself to mass building and which is easily adapted to a wide variety of residential designs.

A further object of the present invention is to provide a concrete building structure that requires only a minimum amount of maintenance.

A further object of the present invention resides in providing a building system wherein the walls thereof are comprised of composite concrete pads or slabs and wherein no skill carpenters are required to actually set the walls.

Another object of the present invention resides in the provision of a residential building system that eliminates a substantial lumber requirement.

Other objects and advantages of the present invention will become apparent and obvious from a study of the following description and the accompanying drawings which are merely illustrative of such invention.

DETAILED DESCRIPTION OF THE INVENTION

With particular reference to the drawings, there is shown therein a system for building and erecting a concrete structure that includes composite concrete walls that are made up of individual tilt-up concrete pads. In this specification, a disclosure of the basic tilt-up concrete pad will be made. In addition, the specification will include a discussion of a work station including a form assembly that is utilized to manufacture and build the tilt-up concrete pad. Finally, the specification will include a discussion of combining the individual tilt-up concrete pads to form a composite concrete wall structure and to in turn provide a concrete building structure which in the present disclosure will be of the residential type.

THE TILT-UP CONCRETE PAD

Figure 1:
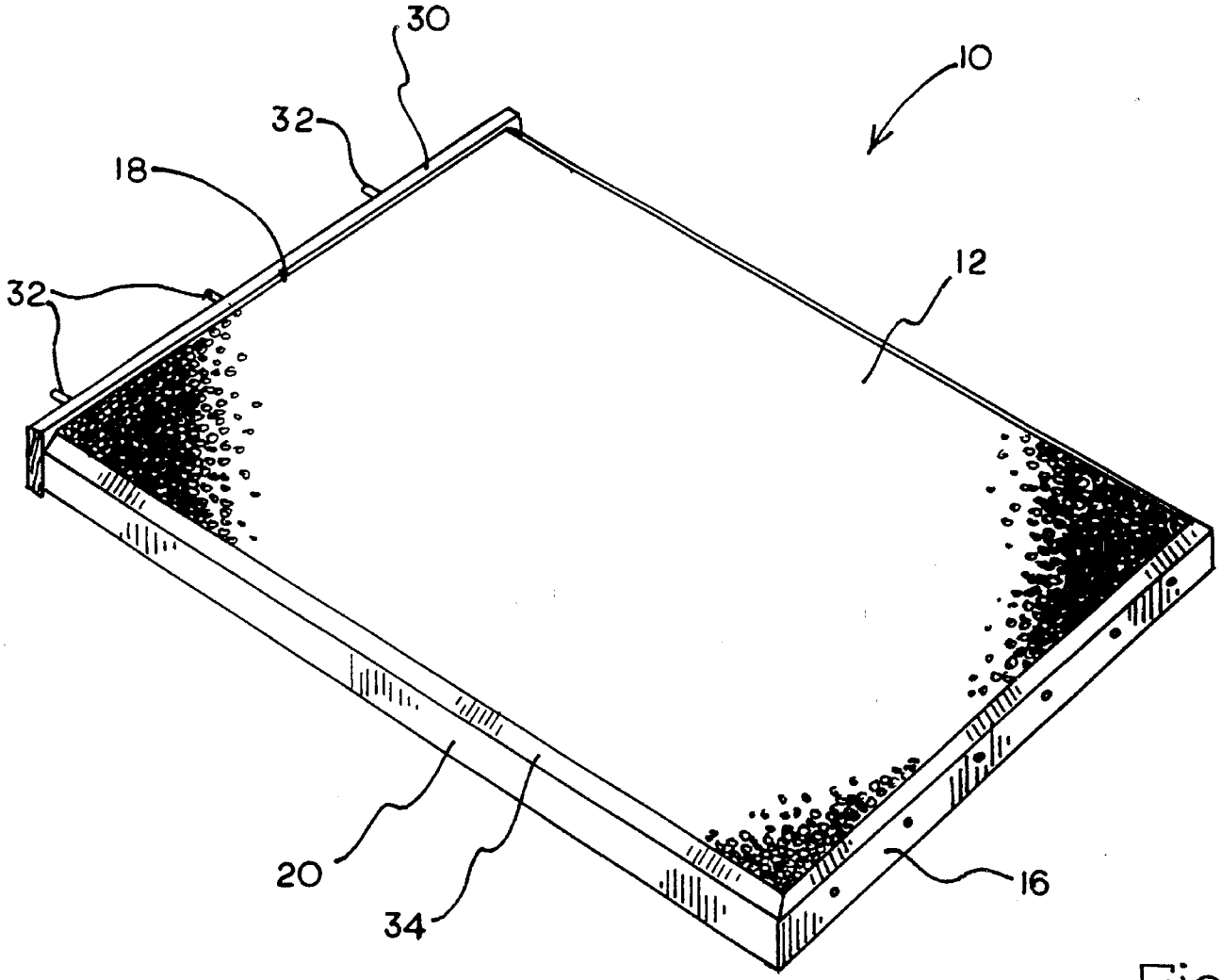
FIG. 1 is a perspective view of the tilt-up concrete pad of the present invention.

With reference to the drawings, and particularly FIG. 1, the tilt-up concrete pad is shown therein and indicated generally by the numeral 10. Basically, concrete pad 10 includes a front side 12 and back side 14. It is appreciated that the front side can be formed of various concrete or masonry type products to give a desired exterior appearance. For example, in the design shown in the drawings, the front side 12 of the concrete pad includes a textured or exposed aggregate exterior. It is understood that other exterior surfaces such as stucco could also be used. Continuing to refer to the tilt-up concrete pad 10, it is seen that each pad includes a bottom edge 16, a top edge 18, and a pair of opposed side edges 20.

Figure 8:
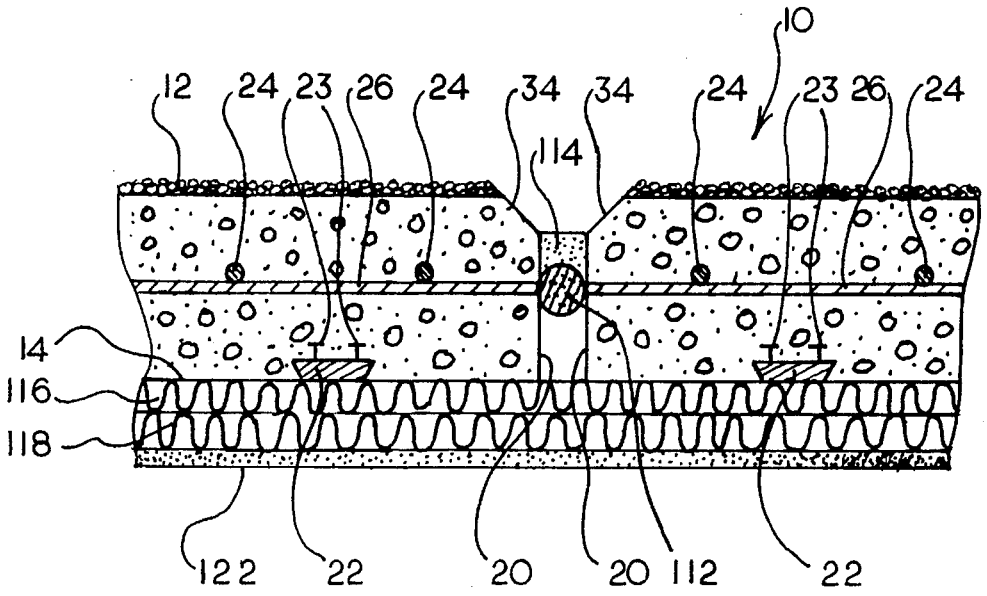
FIG. 8 is a horizontal vertical sectional view of a section of a composite concrete wall formed in accordance with the present invention.

The concrete pad 10 is designed such that when the same is erected and disposed adjacent another like concrete pad 10 that there will be formed about the front juncture of the pads a V-shaped joint. See FIGS. 1, 5 and 8. The V-shaped joint is provided by particularly chamfering the edge that exists between the front side 12 and the respective side edges 20 of the concrete pad. Thus, as shown in FIG. 1, each concrete pad 10 includes a pair of front chamfered edges 34. As will be more fully appreciated from a discussion of the casting process, the chamfered edges 34 are arrived at by placing chamfered blanks 33 (FIG. 5) in the casting form and effectively removing the blanks once the concrete pad 10 has been formed.

Extending vertically along the back side of the concrete pad 10 is a series of vertical nailers 22, preferably constructed of treated wood. Although the number of nailers may vary depending on the size of the concrete pad 10 and/or the particular application, the present embodiment which happens to be approximately 8 feet by 6 feet utilizes three appropriately spaced vertical nailers 22.

The thickness of the concrete slab 10 can vary depending on the application and strength required. However, in a preferred embodiment where the concrete pad 10 is used in conventional residential construction, it is contemplated that the concrete pad will preferably be 4½ inches thick.

It is seen that each nailer 22 includes a series of anchor nails extending rearwardly from the nailer 22 into the precast concrete. Also, it is noted that the side edges of the nailers 22 are beveled such that the precast concrete itself tends to lock the nailers 22 within the pad 10 itself.

Figure 4:
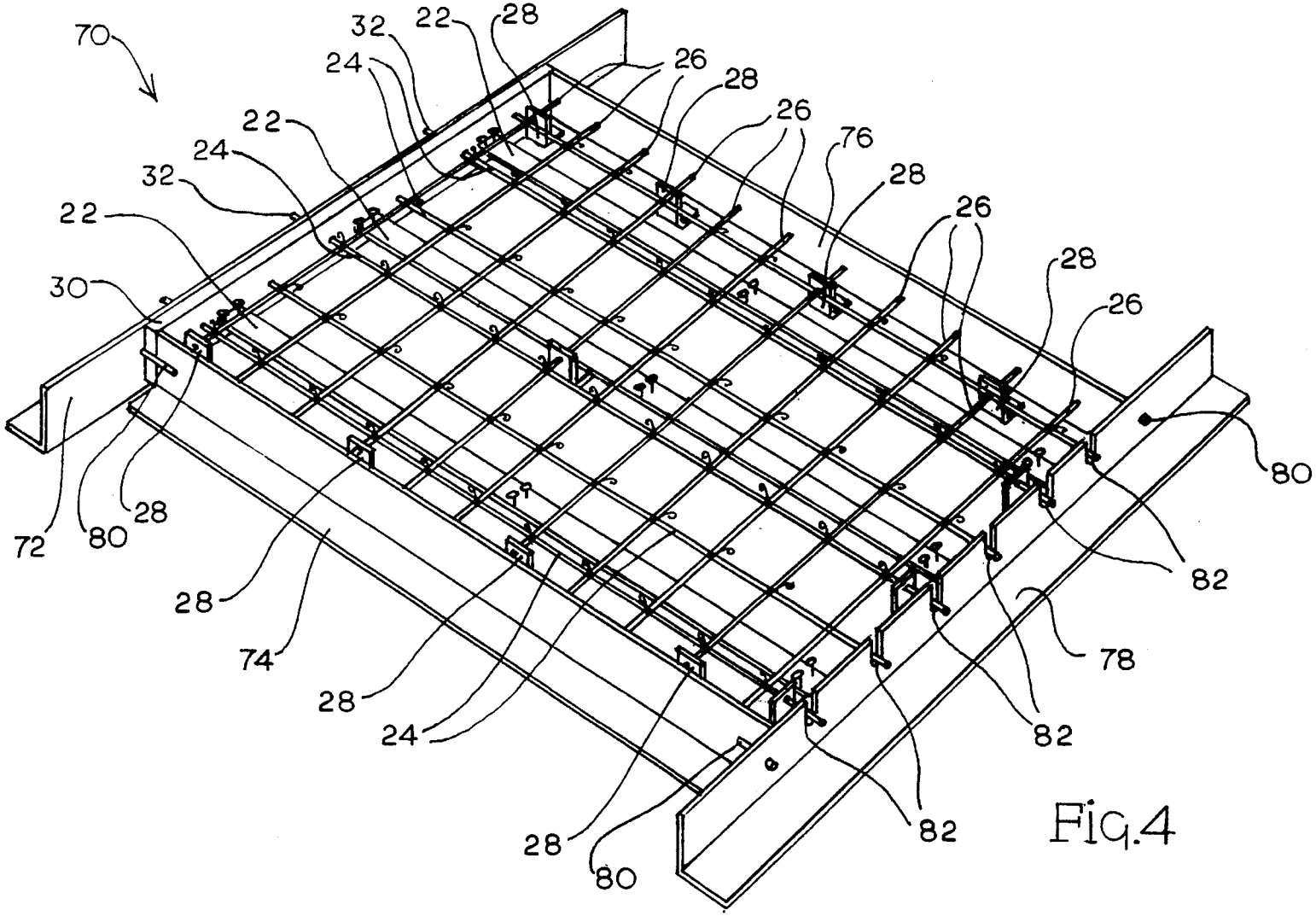
FIG. 4 is a perspective view of a form utilized to pour the concrete pad with the basic internal structural elements of the concrete pad being shown within the form prior to pouring.

Each concrete tilt-up pad 10 is reinforced by conventional rebar. In this regard, as seen in FIG. 4, note that each concrete pad includes a series of vertical steel rods 24 that are embedded into the concrete pad 10. Further, there is provided a series of cross steel bars 26 that are appropriately spaced and extend across the vertical steel rods 24. Thus, it is appreciated that the entire concrete pad 10 is reinforced throughout and generally uniformly by the steel rods 24 and 26.

Also, each concrete pad includes a series of spaced apart anchor plates 28 embedded within the precast concrete pad 10. Note that each anchor plate includes an embedded leg **28*a* that includes an opening formed therein. Extending at a right angle from the embedded leg 28*a* is a weld pad 28*b*. Note that the selected rebar 24 and 26 extend through the central opening in respective legs 28*a* of the anchor plates 28. This effectively ties the anchor plates 28 to the reinforced rebar that is cast within the concrete pad 10. Also, the anchor plates 28 play a role in establishing the position or height of the rebar within the concrete pad 10 since the certain rebar rods 24 and 26 are supported by the respective anchor plates 28 above the work station which will be subsequently discussed. A most important feature of the present invention entails the final placement of the weld pads 28*b* that form a part of each anchor plate 28. Note that the design of the anchor plate 28 is such that the weld pad 28*b* lies flush with the back side 14 of the concrete pad 10. Thus, it is appreciated that the leg 28*a* of each anchor plate 28 extends through the concrete pad 10 and at the back side 14 the anchor plate 28 turns such that the weld pad 28*b* lies flush with the back side 14** of the concrete pad.

Anchor plates 28 are uniformly distributed about the side edges and bottom edge of the concrete pad. In fact, as seen in the drawings, one will note that the flush mounted weld pads **28*b* are spaced along the back side 14 adjacent the side edges 20 and the bottom edge 16. This will enable each tilt-up concrete pad 10** to be connected to an adjacently disposed concrete pad as well as to the foundation and particularly a concrete floor that forms a part of the foundation of a building.

In the present case, the concrete pad 10 includes a top plate 30 (preferably of treated wood) that is integrally formed with the pad 10. Typically, the top plate 30 would be of wood construction and would be secured to the top edge 18 of the concrete pad 10 by a series of anchor bolts 32. Note that the anchor bolts 32 are spaced along the top plate 30 and extend entirely through the top plate and in fact project into the precast concrete pad 10. Of particular importance is the fact that the respective anchor bolts 32 are extended inwardly into the precast concrete pad and actually connect to the reinforcing rebar structure within the concrete pad 10. In particular, the respective anchor bolts 32 are projected into the concrete pad such that they engage an upper portion of selected vertical rebar 24. There, the respective anchor bolts are tied or secured to the vertical rebar 24 by a weldment or other suitable means. That portion of the anchor bolt 32 that projects outwardly from the top plate 30 is provided with a conventional threaded end. The exposed threaded end is designed to be inserted through a second upper top plate after which the threaded anchor bolt receives an appropriate securing nut.

That essentially describes the basic structure of the tilt-up concrete pad 10 of the present invention.

THE WORK STATION

Figure 2:
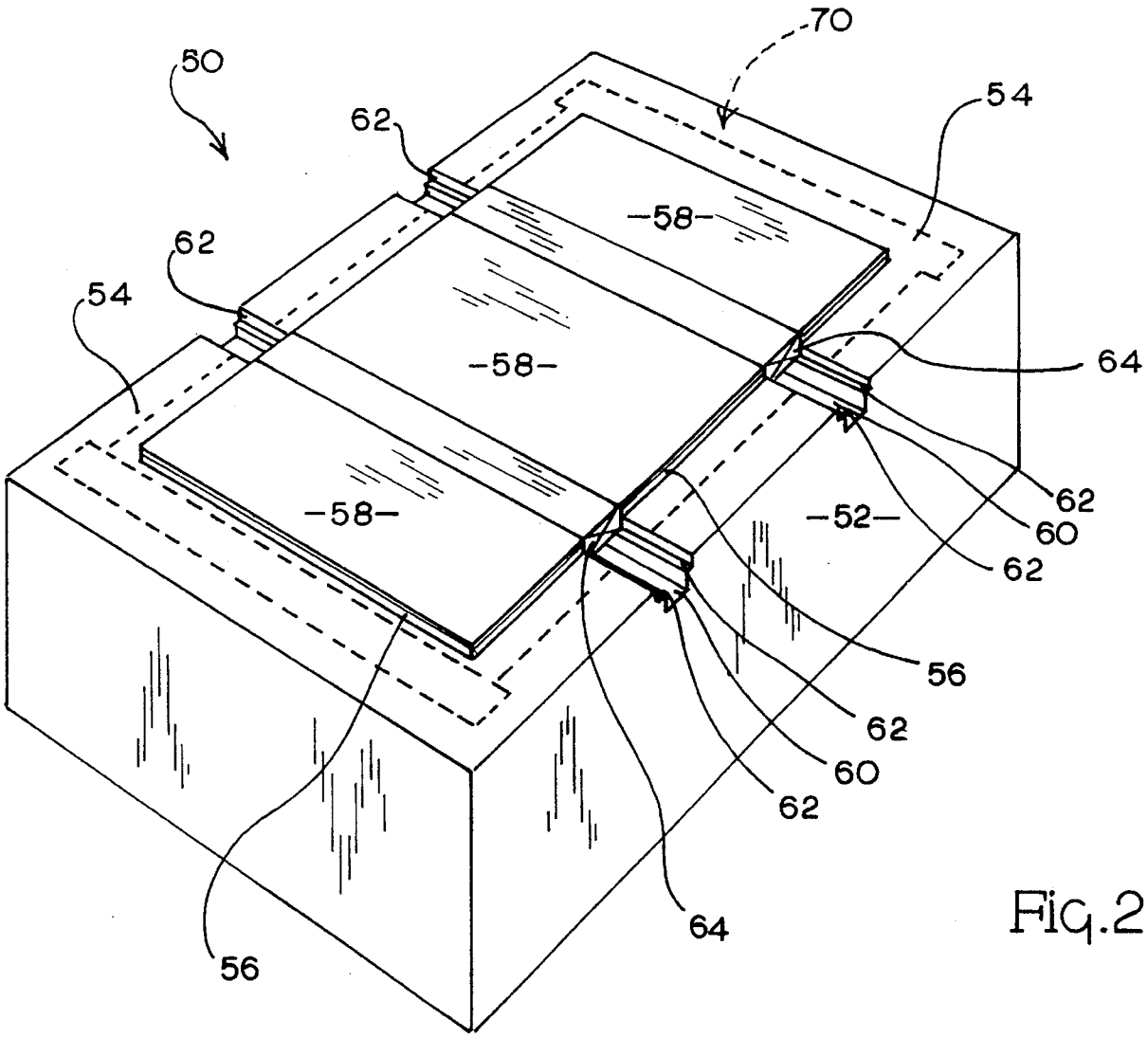
FIG. 2 is a perspective view of the work station that is utilized to produce the tilt-up concrete pad of the present invention.
Figure 3:
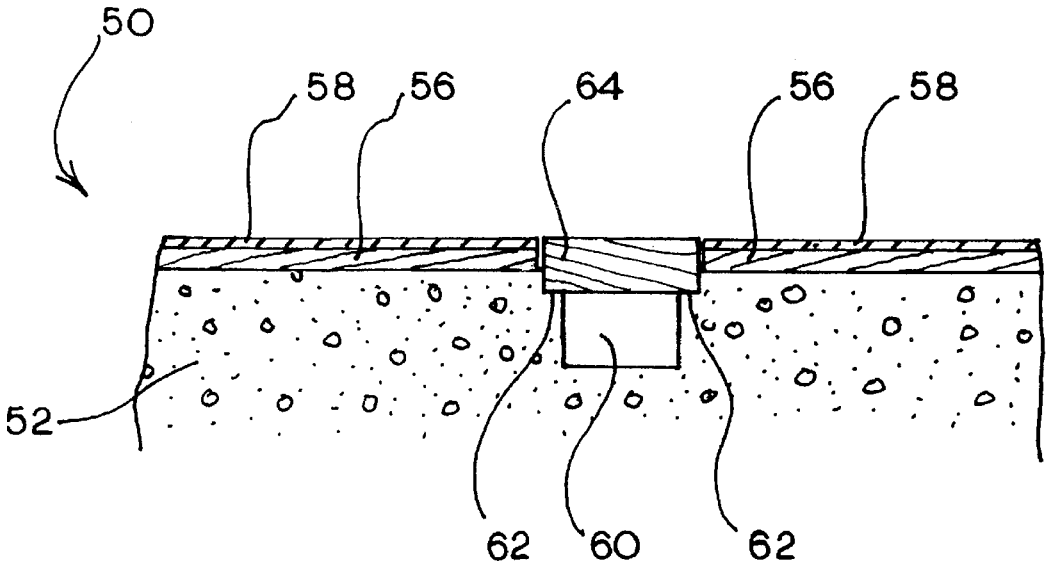
FIG. 3 is a fragmentary sectional view showing the forklift access opening that forms a part of the work station.

Now, turning to the work station and particularly FIGS. 2 and 3, the work station of the present invention is indicated generally by the numeral 50. The purpose of the work station 50 is to provide a convenient and efficient environment for producing the tilt-up concrete pad 10 just described.

Turning to a discussion of the work station, it is seen that the same includes a base 52. The base 52 includes a top that forms a form support surface 54. Disposed interiorly within the form support surface 54 is a series of raised pads 56. It would be beneficial for the raised pads 56 to include a top surface that easily separates from concrete. Therefore, it is contemplated that the raised pads 56 would include a top surface 58 that would be constructed of a metal plate or in the alternative could be a wood surface.

In the case of the embodiment disclosed herein, the work station includes three raised pads 56. It is appreciated however that the number of raised pads 56 can vary depending upon need and application. However, in the embodiment disclosed herein, there is provided a pair of forklift openings 60 defined between the center raised pad 56 and each of the outer raised pads 56. It is appreciated that each forklift opening 60 includes a bottom surface. Disposed above the bottom of each forklift opening 60 on opposite sides thereof is a continuous transverse ledge 62. Ledge 62 is designed to receive and support a forklift skid 64 over the forklift opening 60. As seen in the drawings, the forklift skid 64 will be supported by the ledge 62 such that the forks of a conventional forklift can be inserted below the forklift skids 64 and into and through the forklift openings 60. Note that the design of the forklift openings 60 and the ledge 62 is such that the top of the forklift skid 64 is generally co-planer or even with the top of surfaces 58 of the raised pads 56.

Now turning to the form structure used in conjunction with the work station 50, it is seen in the drawings that there is provided a detachable form structure indicated generally by the numeral 70. The detachable form structure 70 includes four separate form members 72, 74, 76, and 78. In the case of the embodiment shown herein, each of the form members 72, 74, 76, and 78 comprise a single piece of angle iron. It is important that the form members 72–78 be connected together in such a fashion that they can quickly and easily be connected and disconnected. To provide this feature, there is incorporated a quick connect bolt assembly 80 at each corner of the completed form structure 70.

At least one form member, 78 in the case of this disclosure, is provided with a feature that assists in laying the reinforcing rebar within the pad prior to casting. This feature includes a series of U-shaped slots 82 formed in the top surface or edge of the bottom form member 78. The depth of the slot is particularly gauged such that the vertical rebar 24 would be spaced appropriately within the concrete pad 10. While the lower end of the vertical rebar 24 is supported within the respective slots 82, the upper end of the same vertical rebar 24 is held at a selected height above the work station by the anchor bolts 32 that are in turn connected to the vertical rebar 24 and which extend through the top plate 30.

Therefore, it is appreciated that to form the concrete pad 10 of the present invention that the various form members 72, 74, 76, and 78 are supported on the form support surface 54 of the work station 50. Note that the respective form members 74–78 are pulled tightly adjacent the surrounding raised outer edges of the respective raised pads 56. Once this has been done, it is appreciated that the top surfaces 58 along with the top of the forklift skid 64 forms the bottom surface of the total form. Thereafter, the respective rebar 24 and 26 is placed within the boundaries of the form members 72–78 as illustrated in FIG. 4. Also, the top plate 30 is disposed inside the upper form member 72 and the respective anchor bolts 32 are tied to adjacent rebar portions and extended through both the top plate 30 and the top form member 72.

Anchor plates 28 are distributed about the form in particular spaced apart relationship. In particular, the weld pads **28*b* of each anchor plate 28 is placed flush down on the top surface 58 of the raised pads 56 along each side edge 20 and along the bottom edge 16. The leg portions 28*a* of each anchor plate 28 project up into the formed area and because the legs 28*a* have openings formed therein, certain rods of the rebar are projected through the openings within the legs 28*a*. This serves two functions. First, the anchor plates 28 serve to support certain portions of the rebar at a particular depth within the pad 10 to be formed. Secondly, the anchor plates 28** are actually tied or secured by weldment or other suitable means to the reinforcing structure.

Before the form 70 is appropriately set on the work station 50, the forklift skids 64 are set in place on the ledges 62. Also before the rebar is set, the three vertical nailers 22 are appropriately placed and spaced on the bottom of the form as the nailers themselves lay flush against the top surface 58 of the raised pads 56.

Figure 5:
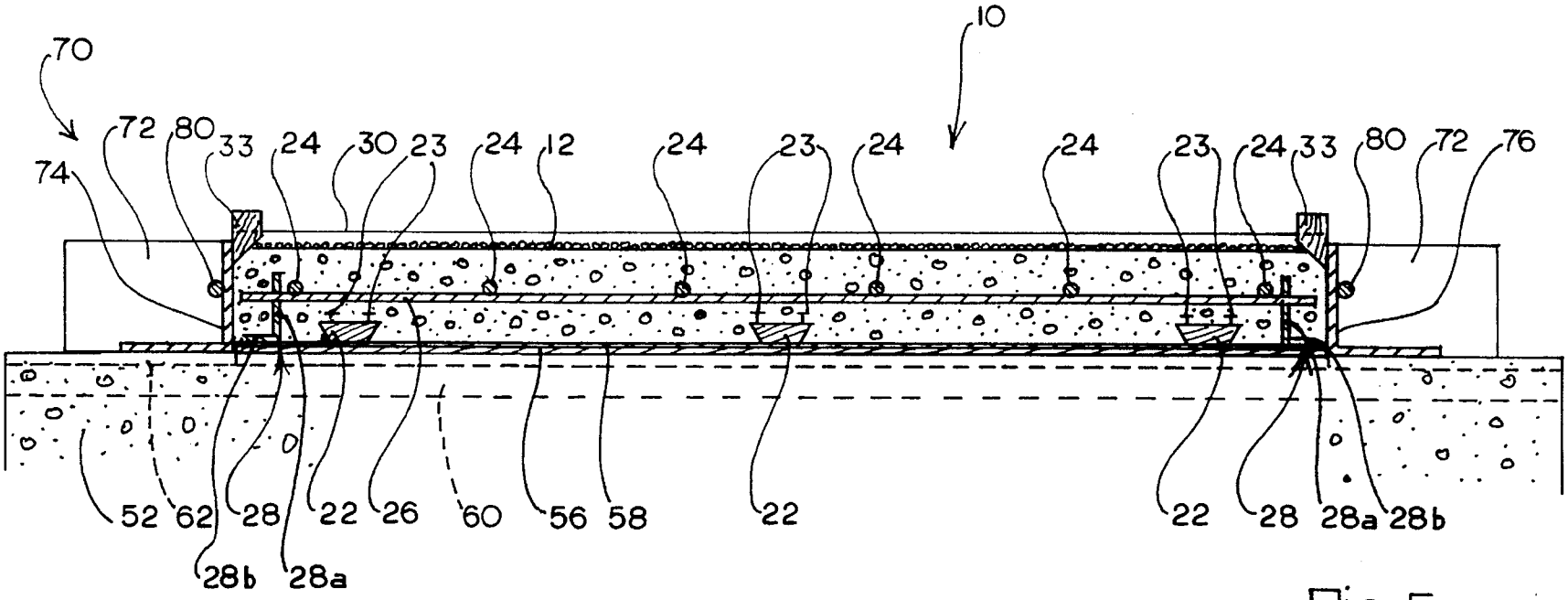
FIG. 5 is a transverse cross-section view taken through the form of FIG. 4 but with the concrete pad shown in section therein.

Once the form 70 has been set and the respective internal components of the pad 10 have been placed within the form, concrete is poured within the form and allowed to set the appropriate time. In addition, the front side 12 of the concrete pad which lies exposed in the form as shown in FIG. 5 is appropriately finished while the pad is disposed on the work station 50. Once the concrete pad has appropriately settled and cured, the form 70 is dismantled from the work station 50. The forks of a conventional forklift is inserted into the forklift openings 60 and the entire precast pad 10 along the forklift skids 64 are removed from the work station 50. The precast and finish pad 10 is then transported to a stacking area where the same is stacked with other pads to await transport to a particular building site. It is appreciated that the forklift skids 64 can be easily and conveniently separated from the back side 14 of the slab 10 and reused.

In the above discussion, the concrete pad 10 shown and described is a basic tilt-up pad construction component that is totally closed and is of a particularly size and configuration. But it is appreciated that other work stations will be provided that will be designed to provide for window openings about selected portions of the pad 10 as well as openings and cavities for other selected accommodations or utilities, etc.

THE RESULTING CONCRETE STRUCTURE

The basic concrete pad 10 described above is used to form a composite concrete surrounding wall structure for a building such as a residential dwelling. The following is a discussion that basically outlines how the concrete pads 10 are erected and tied together on a foundation.

Figure 7:
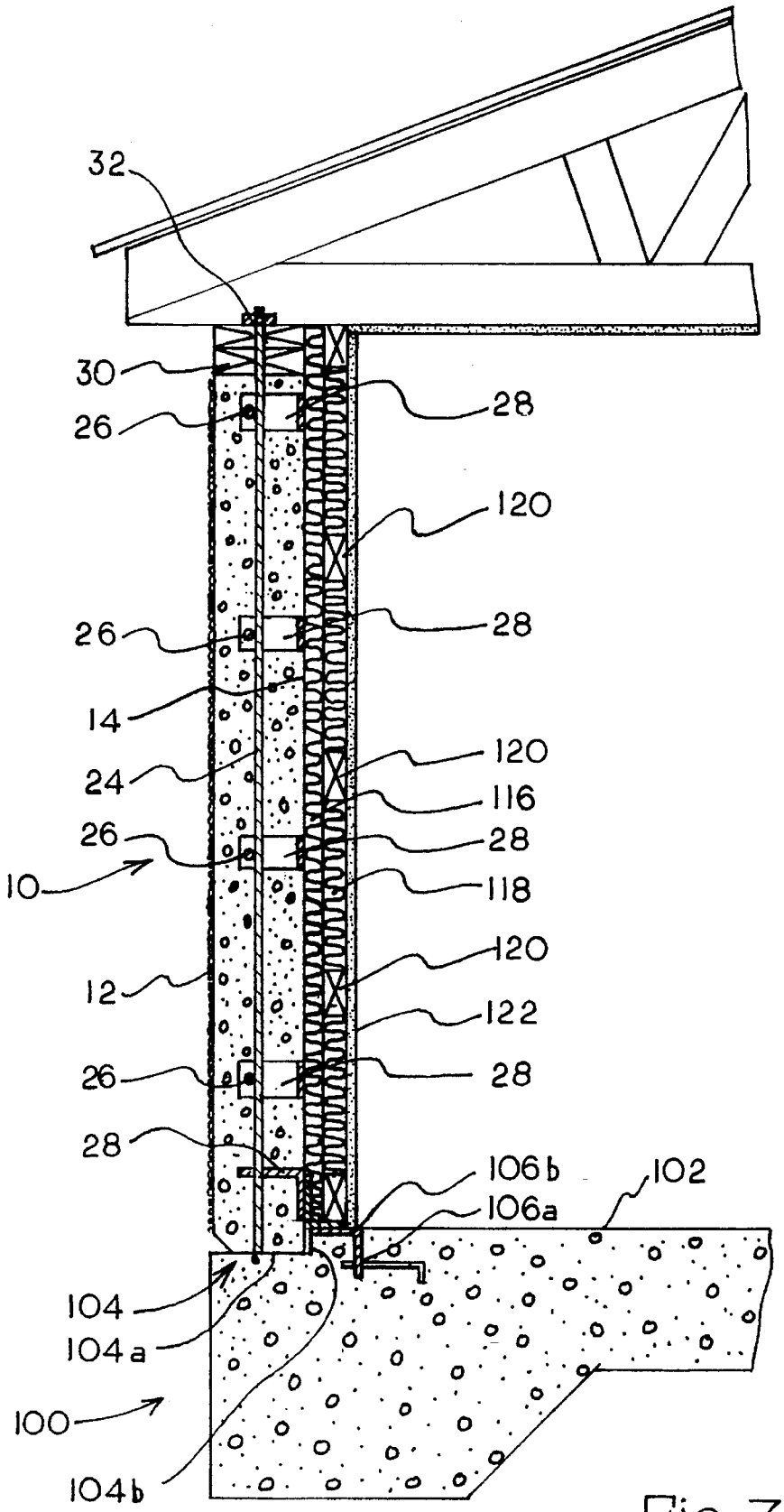
FIG. 7 is a side sectional view showing a finished composite concrete wall formed in accordance with the present invention.

With further reference to the drawings, the basic resulting concrete structure includes a composite foundation and floor indicated generally by the numeral 100. Details of this composite foundation and floor are not dealt with here in detail because such is not per se material to the present invention. But suffice it to note that the composite foundation and floor 100 includes a concrete floor 102 that is effectively tied to footings that are selectively placed around the floor. See FIGS. 7 and 9. Disposed around the periphery of floor surface 102 is a concrete footing and foundation wall that again is integral with the concrete floor. Note that the outer foundation wall includes a step-down wall ledge 104 that is designed to receive the bottom edge 16 of the respective concrete pads 10. Wall ledge 104 includes a bottom 104*a* and an adjacent side edge 104*b*.

Also, the floor of the concrete structure includes anchor plates 106 that are similar to the anchor plates 28 disposed within the respective concrete pads 10. Anchor plates 106 are disposed around the periphery of the concrete floor adjacent the wall ledge 104. In particular, the anchor plates 106 are embedded or cast in place within the top portion of the concrete floor 102. Note that each anchor plate 106 includes a leg 106*a* that extends downwardly into the concrete. There is provided a flush weld pad 106*b* that is co-planer or even with the top of the concrete floor.

Figure 6:
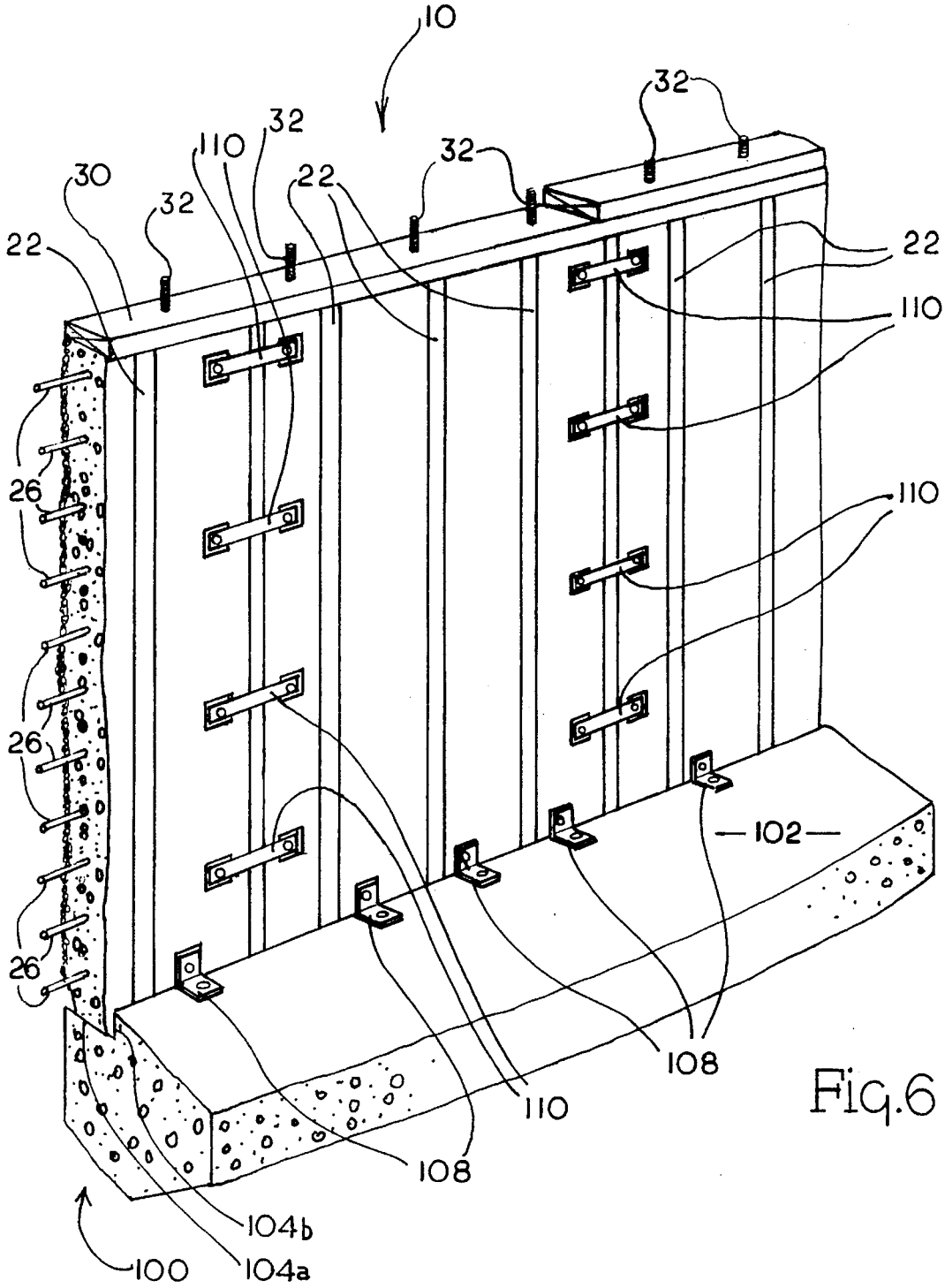
FIG. 6 is a perspective view showing a series of concrete pads secured together on a composite concrete foundation.

The respective concrete pads 10 are tilted up and set on the bottom 104*a* of the wall ledge 104 of the foundation. Note that the bottom edge 16 of the concrete pad 10 is set flush on the bottom surface 104*a*. The back side 14 of the pad 10 faces interiorly within the building structure. In erecting the respective concrete pads 10, a number of such pads are set on the foundation and are temporarily supported in edge-to-edge relationship along the wall ledge 104. It is important during the temporary erection to properly align the respective pads 10 such that they are set in a plumb and square orientation. To connect the respective tilt-up pads 10 together and to the composite concrete floor and foundation 100, there is provided a series of connecting bars 110. Connecting bars 110 are designed to connect respective adjacent concrete pads together. As seen in FIG. 6, note that the connecting bars 110 essentially bridge two concrete pads and connect the adjacently disposed weld pads 28*b* that form a part of each anchor plate 28. In the embodiment illustrated the connecting bars 110 are welded to the respective weld pads 28*b*. It should be pointed out that in addition or in the alternative, the connecting bar 110 can be bolted to the respective weld pads 28*b*. Thus, the respective tilt-up concrete pads 10 are connected about the back side 14 by a series of vertically spaced connecting bars 110 that span the created joint that exists between successive concrete pads.

Now, to secure the base or lower portion of each concrete pad 10 to the concrete structure, there is provided a series of space anchor pads indicated generally by the numeral 108 that connect the base or lower portion of the pad 10 to the concrete floor. In particular, each base anchor pad 108 includes a pair of legs 108*a* and 108*b*. These two legs are secured by weldment or by bolts to the respective weld pads 28*b* and 106*b* of the respective anchor plates 28 and 106. Therefore, it is appreciated that these angled anchor legs 108*a* and 108*b* secure and tie the lower portion of the respective successive pads 10 to the composite floor and foundation 100.

Figure 9:
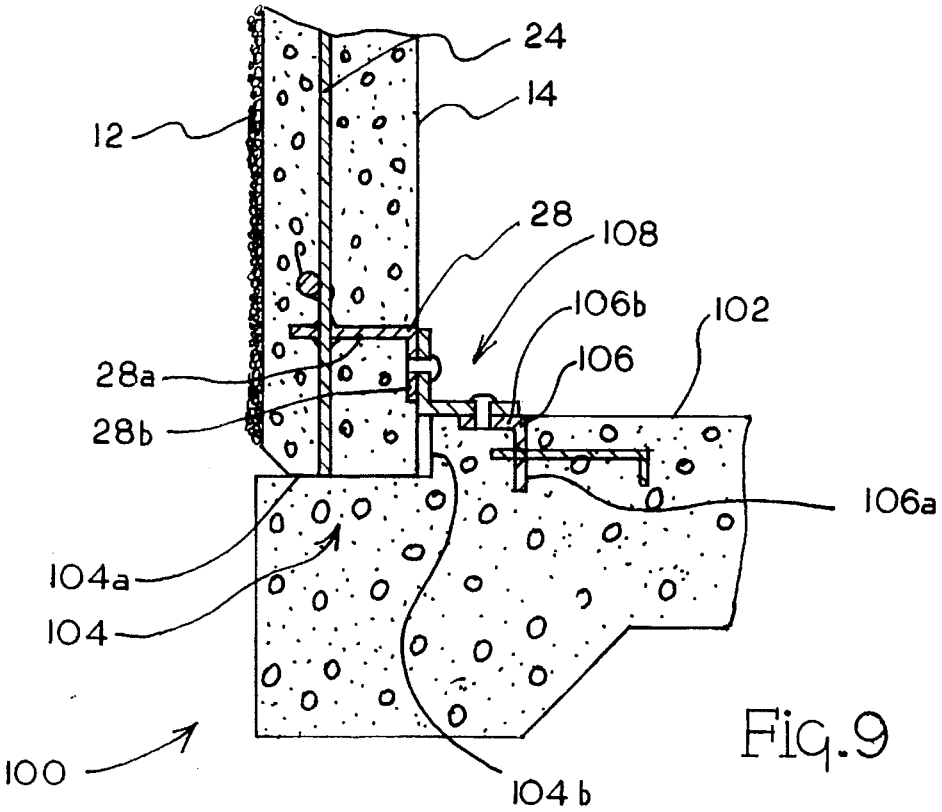
FIG. 9 is a fragmentary sectional view showing a lower portion of a respective concrete pad being disposed and secured to the concrete foundation.

As seen in FIG. 9, one notes that the lower back side 14 of each concrete pad 10 is spaced slightly away from the side edge 104*b* of the wall ledge 104. This permits moisture to drain from the wall into the gap defined between the pad 10 and the side edge 104*b*. By providing exteriorly directed weep holes it is appreciated that moisture, water and the like can drain from the inside of the composite concrete wall structure to the exterior of the building and thereby avoid accumulation of water or moisture.

In erecting the respective concrete pads 10, it is seen that a vertical V-shaped joint is created about the front of the concrete wall between respective concrete pads 10. This is particularly caused by the chamfered edges 34 formed about the side edges of the front side 14 of the concrete pads 10. To close this gap and joint, there is provided an elongated styrofoam rope seal 112 that is wedged in the joint generally intermediately between the front and back sides of the joint. This styrofoam rope seal 112 will seal against infiltration and effectively make the joint between the respective concrete pads 10 airtight.

To finish the V-shaped joint, one can place a concrete grout 114 or other suitable finishing material within the V-shaped joint in front of the styrofoam rope seal 112. This completes the joint and gives the concrete wall structure a pleasing exterior appearance.

To finish the interior portion of the composite concrete wall, a number of approaches may be taken. But it is preferable that there be a very good insulation secured to the back side 14 of the concrete pad 10. This in the present disclosure is accomplished by a pair of conventional insulation sheets 116 and 118 that are disposed back-to-back. These insulation sheets 116 and 118 can be effectively secured to the concrete wall by using nails or other connectors to connect the sheets 116 and 118 to the various nailers 22. Prior to securing the second insulating sheet 118 to the interior walls, it may be preferable to secure cross-nailers 120 at various heights along the interior wall, with the cross-nailers 120 being secured to the first insulating sheet 116. Note that the cross-nailers 120 are vertically spaced, and are approximately 2 foot on center in this design, and are themselves secured to the vertical nailers 22. It also should be noted that a 6 mil moisture barrier would preferably be interposed between the inside wall of the concrete pad 10 and the cross-nailers 120. Thereafter, the second insulating sheet 118 is secured between the respective cross-nailers 120. Thereafter, a finishing board such as gypboard, sheetrock or the like is secured to the second insulation sheet 118 by attaching the finishing board 122 to the cross-nailers 120. It is appreciated that the finished wall in a typical residential structure would be approximately eight inches thick and the total wall insulation should exceed an R-16 value. One is referred to the drawings and particularly to FIG. 7 for a cross-sectional view of the finished wall section.

As seen in the drawings, the composite wall includes a second top plate that is bolted above the first top plate 30. Thereafter, a roof truss structure is secured across the wall. In order to provide a strong and rigid wall and roof structure, roof truss straps are interconnected between the double top plate and the respective roof trusses.

Finally, door and window framing is provided with treated wood that is secured to respective concrete pads 10 and particular openings formed therein. A finished grade lumber is nailed to the treated wood to provide an asthetically pleasing trim.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims fare intended to be embraced therein.

What is claimed is:

1. A tilt-up concrete panel comprising:

a) a concrete panel having front and back sides and a surrounding periphery edge structure including top, bottom and side edges and wherein the surrounding periphery edge structure of the panel is substantially formed by concrete;

b) at least one nailer formed and embedded in the concrete panel and extending exposed across a substantial portion of the back side of the concrete panel;

c) reinforcing steel rods embedded within the cast concrete panel; and d) a plurality of individual embedded angled anchor plates embedded within the concrete panel in spaced apart relationship and within the confines of the surrounding periphery edge structure of the concrete panel, each angled anchor plate including a leg and a weld pad with the weld pad being disposed at an angle of approximately 90° degrees with respect to the leg, and wherein each leg is secured to a respective steel rod and projects from within the concrete panel toward the back side of the concrete panel and is particularly positioned within the panel such that the angled weld pad lies flush with the back side of the concrete panel such that respective concrete panels can be connected by securing connectors to the weld pads disposed on the back side of adjacently disposed concrete panels.

2. The tilt-up concrete panel of claim 1 wherein respective legs of the anchor plates have openings formed therein and wherein respective steel reinforcing rods embedded in the cast concrete panel extend through openings of the respective legs of the anchor plates.

3. The cast concrete panel of claim 1 including at least two nailers that extend vertically along the back side of the cast concrete panel.

4. The cast concrete panel of claim 1 including an top plate set in place that extends across the top edge of the cast concrete panel.

5. The cast concrete panel of claim 4 wherein the top plate includes a wooden member and wherein there are connectors that connect the top plate to the cast concrete panel with the connectors extending from the top plate and being embedded into the cast concrete panels such that the top plate is integral with the cast concrete panel.

6. The cast concrete panel of claim 4 including anchor bolts secured to the reinforcing steel rods and which extend outwardly through the top plate effectively securing the top plate to the cast concrete panel and wherein the anchor bolts include threaded ends that extend outwardly from the top plate.

* * * * *